United States Patent [19]

Neidorff

[11] Patent Number: 4,795,961

[45] Date of Patent: Jan. 3, 1989

[54] LOW-NOISE VOLTAGE REFERENCE

[75] Inventor: Robert A. Neidorff, Bedford, N.H.

[73] Assignee: Unitrode Corporation, Lexington, Mass.

[21] Appl. No.: 60,622

[22] Filed: Jun. 10, 1987

[51] Int. Cl.[4] ..... G05F 3/30

[52] U.S. Cl. ..... 323/314; 323/907

[58] Field of Search ..... 323/312, 313, 314, 315, 323/316, 907; 307/296 R, 297

[56] References Cited

U.S. PATENT DOCUMENTS

| | | | |
|---|---|---|---|
| 3,887,863 | 6/1975 | Brokan | 323/314 |
| 4,087,758 | 5/1978 | Hareyama | 323/314 |
| 4,352,056 | 9/1982 | Cave et al. | 323/314 |
| 4,422,033 | 12/1983 | Minner et al. | 323/314 |

OTHER PUBLICATIONS

"A Simple Three-Terminal IC Bandgap Reference", A. Paul Brokaw, IEEE Journal of Solid-State Circuits, vol. SC-9, No. 6, Dec. 1974, pp. 388-393.

*Primary Examiner*—Peter S. Wong

*Attorney, Agent, or Firm*—Weingarten, Schurgin, Gagnebin & Hayes

[57] ABSTRACT

A band-gap voltage reference having reduced output voltage noise. The invention embraces several novel concepts, including the optimization of transistor area ratios as used in the band-gap device, the selection of multiple transistors in the Vbe, the section of the current range for the band-gap device, resistive loads to provide minimum load noise and selective signal filtering before the output amplifier. The resulting device according to the present invention exhibits lower output voltage noise than previous band-gap voltage references, without sacrificing other important voltage reference parameters, such as line regulation, load regulation, temperature coefficient, and stability.

8 Claims, 2 Drawing Sheets

LOW-NOISE VOLTAGE REFERENCE

FIELD OF THE INVENTION

The present invention relates to solid state voltage reference elements and, in particular, to low-noise band-gap voltage reference elements.

BACKGROUND OF THE INVENTION

Traditional voltage reference devices have included either Zener diodes or band-gap devices. The Zener diodes exhibit problems such as long-term drift, unpredictable temperature drift and poor manufacturability. Band-gap references suffer from voltage noise on the output signal due to the very high internal gain of the band-gap amplifier transistors. The band-gap voltage references provide low drift voltages by adding negative temperature drift voltages to positive temperature drift voltages in the appropriate proportion. As shown in the the prior art of FIG. 1, the negative coefficient voltage is the base-emitter voltage drop of an NPN transistor. The positive temperature coefficient voltage is the difference between the two base-emitter voltage drops amplified by twice the emitter ratio to R1 and R2. Therefore, the output voltage is:

$$Vbg = Vbe_1 + 2\,(R1/R2)(Vbe_2 - Vbe_1) \qquad (1)$$

Since the resistors are typical low noise, a principal noise contribution to Vbg is from the transistor Vbe and, more specifically, from the difference between $Vbe_2$ and $Vbe_1$. The noise is more evident when it is realized that R1 is normally between five and six times R2 to get a zero voltage drift over changing temperature.

SUMMARY OF THE INVENTION

The circuit according to the present invention reduces the dependence of Vbg on Vbe noise in one or more of the following five novel aspects of the present invention:

First, the magnitude of the positive temperature drift voltage is made as large as practical before amplification by the amplifier so that the ratio of R1 to R2 is minimized.

Second, the positive and negative temperature drift voltages are multiplied by stacking additional semiconductor elements in the emitter circuits of the respective transistors. In the embodiment shown in FIG. 2, three junctions are provided, wherein the noise contributions are statistically average to produce the square root of three times the noise. Additional diodes can be added for each leg, as desired.

Third, the transistor noise itself is minimized by using higher collector currents.

Fourth, the circuit according to the present invention eliminates the active load devices frequently used in band-gap circuit implementations, and resistive loads used in place thereof.

Fifth, the feedback amplifier includes a symmetric low-pass RC filter which simultaneously attenuates high frequency noise and compensates the feedback system of the circuit.

The resulting device provides a low-noise reference which is typically 15 dB lower in noise than common band-gap references and is comparable to current integrated circuit Zener references built from special processes. Moreover, the invention does not require special processing for time stability or low-noise as Zener references do, nor does it use a heater to reduce drift as required by other devices. As a result, the low-noise voltage reference element according to the present invention provides an output noise well below 0.1 LSB for twelve bit analog-to-digital converter applications.

BRIEF DESCRIPTION OF THE DRAWING

These and further features of the present invention will be better appreciated by reading the following detailed description, taken together with the drawing wherein.

DETAILED DESCRIPTION OF THE INVENTION

Figure 1:
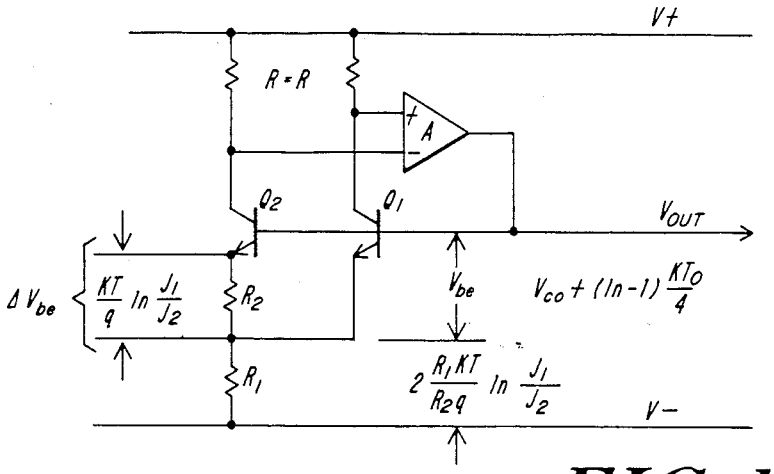
FIG. 1 (PRIOR ART)
FIG. 1 is a circuit illustrating an idealized two transistor band-gap device.
Figure 2:
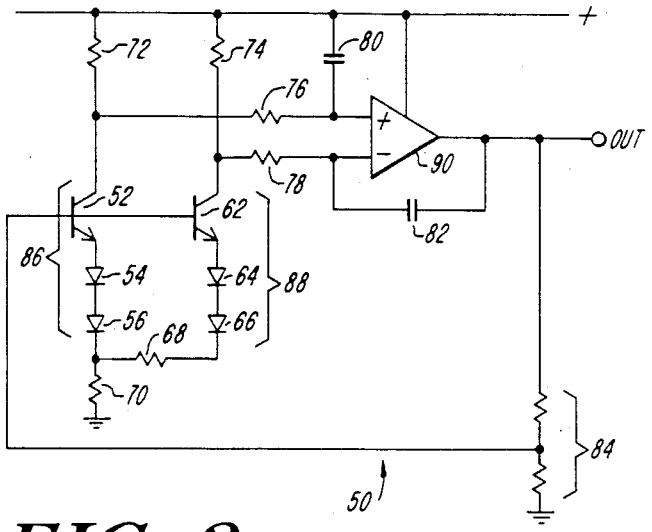
FIG. 2 is one embodiment of the present invention.

The preferred embodiment 50 shown in FIG. 2 includes a pair of transistors 52 and 62 having a common base. The emitter of transistor 52 is connected to two diode-connected transistors 54 and 56. Similarly, the emitter of transistor 62 includes diode-connected transistors 64 and 66. The transistor 66 is connected to a first resistor 68 which is connected to a second resistor 70 as well as the diode-connected transistor 56. The remaining end of resistor 70 is connected to the voltage return, ground. It is according to one inventive aspect of the present invention that the characteristics of diodes 54, 56 and 64, 66 are added, which provides a voltage reference having a lower output noise since the noise produced is a statistical average. That is, the noise power adds according to the square root and not a linear proportion derived from the voltage. The load elements of transistors 52 and 62 comprise resistors 72 and 74, which provides lower noise than active collector load elements.

According to another invention feature, the present invention makes the difference $Vbe_2 - Vbe_1$ larger, reducing the gain of the amplifier 90 and thus reducing the output noise. In so doing, the areas ratios of the descendent second leg 88 is made significantly larger than the transistor area ratio of the first leg 86. The embodiment in the present invention has an emitter area ratio (leg 88:leg 86) of 800:1 and in other embodiments of at least 1000:1 whereas the typical existing band-gap element has an area ratio of 8:1. According to the present invention, the larger the area ratio, the more the noise is reduced in view of a reduced amplifier gain.

The potential across the collector of transistors 52 and 62 is amplified by amplifier 90 after being filtered with a filter symmetric for both inputs of the amplifier amp 90. Each filter includes an input resistor 76 and 78 and high frequency roll-off capacitors 80 and 82, thereby making a low-pass RC filter, and in the particular embodiment forming an integrator. The signal from the amplifier 90 is scaled by voltage divider 84 and received by the common bases of transistors 52 and 62. Accordingly, the voltage differential from the collectors of transistors 52 and 62 is compared, amplified and returned to the base of each transistor, wherein a constant voltage is maintained over varying temperature conditions, and having a low output noise according to the present invention.

Figure 2A:
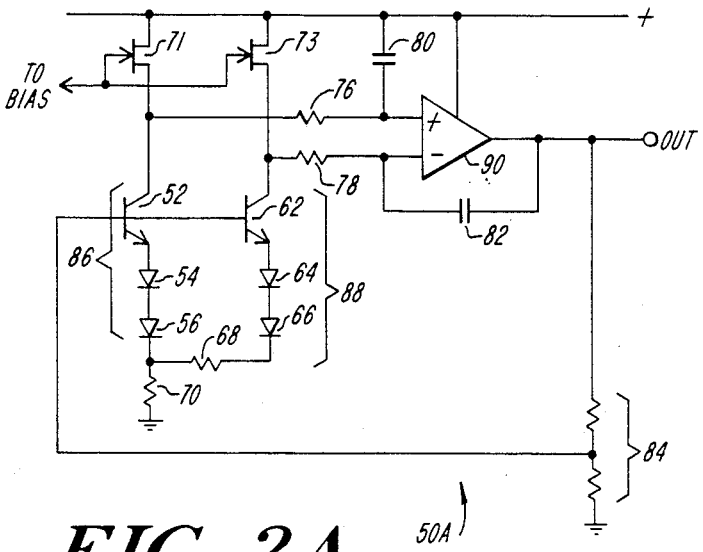
FIG. 2A is an alternate embodiment of FIG. 2 providing FET collector loads.

An alternate embodiment 50A of the invention of FIG. 2 is shown in FIG. 2A wherein transistors 52 and 62 have active load devices comprising field affect transistors 71 and 73. Each of the field affect transistors 71 and 73 is connected to a bias voltage, as may be provided by one of several known techniques.

Modifications and substitutions made by one skilled in the art is within the scope of the present invention which is not to be limited except according to the claims which follows:

What is claimed is:

1. A low noise voltage reference comprising:

a first and a second transistor having a common base, and each having a collector and an emitter;

base drive means for providing a voltage to said common base;

collector load means connected to a power source providing a voltage thereacross in response to the conductance of the respective transistor;

a first resistor connected to the emitter of said first and said second transistor;

a second resistor connected to the emitter of said first transistor and to said power source, wherein said first and second transistors produce current densities according to their respective areas, the ratio between said first and second transistor current densities being selected to produce a ratio of current density provided by the second and first transistors substantially greater than the range of 8 to 1 to at least 1000 to 1, and the output reference voltage comprising the base drive voltage which provides equal collector voltages.

2. The low noise voltage reference of claim 1, wherein said base drive means comprises an operational amplifier having a non-inverting input connected to the collector of said first transistor and the inverting input connected to the collector of said second transistor, the output being connected to said common base and providing the output reference voltage.

3. The low noise voltage reference of claim 1, wherein said collector load means comprises one of a plurality of resistors and a plurality of Field Effect Transistors.

4. The low noise voltage reference of claim 1, wherein said ratio of current density is at least 20:1.

5. A low noise voltage reference comprising a first and a second transistor having a common base, each having a collector and an emitter;

base drive means for providing a voltage to said common base, collector load means connected to a power source and to each transistor for providing a voltage thereacross in response to the conductance of the corresponding transistors;

a first plurality of serial connected diodes connected to the emitter of said first transistors;

a second plurality of serial connected diodes connected to the emitter of said second transistor;

a first resistor connected to said first and second plurality of serial connected diodes;

a second resistor connected to said first plurality of serial connected diodes and to said power source, wherein said first transistor and said first plurality of serially connected diodes provide a current density relative to the current density of said second transistor and said second plurality of serially connected diodes according to their respective junctions areas; and said base drive means provides the low-noise reference voltage output at said common base when the respective collector load voltages are equal.

6. A method of providing a low-noise voltage reference, providing a flow of current through each of a first and a second band-gap reference devices providing noise current and noise voltage signals; and adjusting the flow of current through each band-gap reference devices until the noise current dominates the noise voltage, providing an impedance match of the band-gap reference devices wherein noise is minimized.

7. A low noise voltage reference comprising:

a first and a second transistor having a common base and each having a collector and an emitter;

collector load means connected to a power source and to each transistor for providing a voltage thereacross in response to the conductance of the corresponding transistors;

a first resistor connected to the emitters of said first and second transistors;

a second resistor connected to said emitter of said first transistor and to said power source; and means for providing said low-noise reference voltage, said low-noise reference voltage being connected to said common base, said means for providing further including low-pass filter means having:

a differential amplifier;

at least one input resistor connecting a collector to said differential amplifier; and at least one capacitor connected to the junction of said differential amplifier and each said input resistor.

8. The low-noise voltage reference of claim 7, wherein said means for providing a low-noise reference voltage comprises an integrator.

* * * * *